US005516592A

United States Patent [19]

Yang et al.

[11] Patent Number: 5,516,592

[45] Date of Patent: May 14, 1996

[54] MANUFACTURE OF FOAMED ALUMINUM ALLOY COMPOSITES

[75] Inventors: Chin-Chan Yang, Taipei; Kou-Chang Su, Kaoshing; Wen-Chi Chen; Shan-Chang Chueh, both of Taipei, all of Taiwan

[73] Assignee: Industrial Technology Research Institute, Hsinchu, Taiwan

[21] Appl. No.: 376,260

[22] Filed: Jan. 20, 1995

[51] Int. Cl.[6] ..... B22F 3/26

[52] U.S. Cl. ..... 428/551; 428/547; 428/548; 428/550; 428/558; 428/565; 428/566

[58] Field of Search ..... 428/547, 548, 428/550, 551, 558, 565, 566

[56] References Cited

U.S. PATENT DOCUMENTS

| | | | |
|---|---|---|---|
| 3,617,364 | 11/1971 | Jarema | 117/132 L |
| 3,660,149 | 5/1972 | Kucsma et al. | 117/132 C |
| 3,839,080 | 10/1974 | Jarema et al. | 117/132 B |
| 3,940,262 | 2/1976 | Niebylski et al. | 75/20 F |
| 3,981,720 | 9/1976 | Speed | 75/20 F |
| 4,102,831 | 7/1978 | Osgood | 521/99 |
| 4,973,358 | 11/1990 | Jin et al. | 75/415 |
| 5,112,697 | 5/1992 | Jin et al. | 428/613 |

*Primary Examiner*—Donald P. Walsh
*Assistant Examiner*—Scott T. Blum
*Attorney, Agent, or Firm*—W. Wayne Liauh

[57] ABSTRACT

A method for preparing foamed aluminum alloy composites comprising the steps of: (a) placing a liquid hardness-reinforcement composition into a tank, the hardness-reinforcement composition containing about 54~64 wt. % of an inorganic powder, about 35~45 wt. % of a nonflammable curable resin, and about 1 wt. % of a curing agent; (b) placing a foamed aluminum alloy plate having an internal porous body into the tank containing the hardness-reinforcement composition, then applying a pressure of about 10~50 $Kg/cm^2$ onto the foamed aluminum alloy plate for about one to two hours so as to allow the hardness-reinforcement composition to soak into the foamed aluminum alloy plate and form a coated layer on the surface of the porous body; (c) removing the foamed aluminum alloy plate that has been coated with a layer of the hardness-reinforcement composition from the tank; and (d) drying and curing the curable nonflammable resin so as to form the foamed aluminum alloy composite. The inorganic powder can be any mineral powder such as marble, granite, alabaster or serpentine powder. The foamed aluminum alloy composite plates of the present invention has light weight and exhibits excellent heat and sound insulation, and can be used as excellent building construction material for interior and exterior walls, partition walls, floors, and ceilings. If marble powder is used as the inorganic powder, the final polished plates of the present invention can be further imparted with an exquisite marble appearance for decorative effect.

10 Claims, 1 Drawing Sheet

MANUFACTURE OF FOAMED ALUMINUM ALLOY COMPOSITES

FIELD OF THE INVENTION

This invention relates to a family of novel foamed aluminum alloy composites. More specifically, the present invention relates to foamed aluminum alloy composites which, in addition to their characteristic advantages of being light weight and having good heat and sound insulation properties as well as good heat resistance, also provide excellent hardness so as to allow the same to be useful in many industrial applications, such as in building construction and in making vehicle components, where structural strength is important. The present invention also relates to methods for making such strength-reinforced foam aluminum alloy composites.

BACKGROUND OF THE INVENTION

Polyurethane foams and glass wools have been widely used as building construction materials for their good thermal insulation qualities. However, because these materials are pathogenic to human body, alternative foamed materials that are compatible with human health have been the focus of significant industrial interests and extensive research effort.

Foamed aluminum alloys have been developed as a result of these efforts. Foamed aluminum alloys are made by adding a foaming agent into a molten aluminum alloy, so as to form a porous metal body containing numerous air bubbles. The specific density of the foamed aluminum alloys is typically between 0.3~0.5, with a thermal conductivity of about 0.44 Kcal/m-hr-°C. The foamed aluminum alloys also have another advantage in that, because it is highly porous, it provides good sound shielding effect. Furthermore, because the surface of the porous structure is covered with a layer of aluminum alloy oxide, the actual melting point of the foamed aluminum alloys can be elevated to as high as 1,200° C. Therefore, the foamed aluminum alloys will not melt even when they are subject to temperatures greater than the normal melting point of the constituent aluminum alloys of about 660° C.

With the above mentioned advantages, such as light weight, good heat insulation, good sound absorbing quality, and high heat resistance, coupled with their relatively low cost, foamed aluminum alloys should be an excellent candidate for use as a building construction material. However, these advantageous properties of foamed aluminum alloy plates have not been realized, mainly because these materials do not provide adequate strength so as to allow them to be used in meaningful applications. At the present time, the foamed aluminum alloys have only a very limited number of sporadic applications.

Japanese Laid Open Patent Application 1-275831 discloses a method to improve the strength of foamed aluminum alloys by applying an adhesive layer to attach one of the foamed aluminum alloy plate with a thin aluminum plate to form a foamed aluminum alloy composite (layered) plate. Such an adhesion is not very reliable, especially in high humidity and/or high wind environment, wherein these composite materials are expected to be subject to.

Japanese Laid Open Patent Application 3-33060 discloses a method, by which molten aluminum is first poured into a mold before the foamed aluminum alloy is placed inside, so as to form a composite (also layered) foamed aluminum alloy plate containing the foam aluminum alloy plate with an aluminum layer attached thereto. This method does not require an adhesive and thus provides a more reliable bonding between the foamed aluminum alloy layer and the aluminum reinforcement layer. However, since this method is conducted at very high temperature, many technical difficulties are expected especially in mass productions.

Japanese Laid Open Patent Application 2-229997 discloses a method, by which a foamed aluminum alloy plate and a thin plate are joined together, and then a polyurethane resin is caused to infiltrate into the cavities in the form of bubbles in the foamed aluminum alloy plate, so as to provide an adhesion therebetween. The adhesion provided by this method also is not very reliable, especially in harsh environment, such as the high humidity and/or high wind environment described above.

SUMMARY OF THE INVENTION

Having discussed the advantages as well as the disadvantages of foamed aluminum alloys, and the shortcomings of prior art methods to improve the strength thereof, the primary object of the present invention is to develop foamed aluminum alloy composites by compositing the foamed aluminum alloys with a hardness-reinforcement material so as to improve their strength while retaining all the advantages thereof The compositing method disclosed in the present invention, which is the fruit of many years of dedicated research effort by the co-inventors, is extremely reliable even under very harsh environment, and can be easily and inexpensively implemented in mass productions at ambient temperatures.

In preparing the foamed aluminum alloy composites disclosed in the present invention, a foamed aluminum alloy plate is first prepared in the usual manner. Then a liquid hardness-reinforcement composition is prepared. The hardness-reinforcement composition is prepared by mixing (1) about 54~64 wt. % of an inorganic hardness-reinforcement powder, which can be any mineral powder with appropriate hardness, such as marble powder, granite powder, alabaster powder, or serpentine powder, etc; (2) about 35~45 wt. % of a nonflammable curable resin, such as epoxy resin or PVC; and (3) about 1 wt. % of a curing agent such as low molecular weight amine or phenol. The particle size of the inorganic hardness-reinforcement powder should preferably be in the range between 50~100 μm.

After the hardness-reinforcement composition described above is prepared, it is placed into a liquid container. Thereafter the foamed aluminum alloy plate is at least partially immersed into the hardness-reinforcement composition. Because the density of the foamed aluminum alloy plate is substantially lighter than that of the hardness-reinforcement composition, a pressure of about 10~50 $Kg/cm^2$ is applied onto the foamed aluminum alloy plate to keep it immersed and soaked in the hardness-reinforcement composition. This also allows the hardness-reinforcement composition to penetrate into the porous space of the foamed aluminum alloy plate. After about one to two hours of such soaking, the soaked foamed aluminum alloy plate is removed from the hardness-reinforcement composition, and dried to allow the curable resin to be cured, i.e., hardened. Finally the exterior surface of the foamed aluminum alloy composite plate can be polished to give it an aesthetic feeling, such as the appearance of a marble material. The thickness of the coating composition coated on the internal porous surface of the foamed aluminum alloy plate can be adjusted by adjusting the pore size of the porous body through the use of an appropriate foaming agent and/or under an appropriate foaming condition.

The foamed aluminum alloy composite plates of the present invention are light weight and exhibit excellent heat and sound insulation qualities; therefore, they can be used as excellent building construction materials such as for use in preparing interior and exterior walls, partition walls, floors, and ceilings. If marble powder is used as the inorganic hardness-reinforcement powder, the final polished plates of the present invention can be imparted with an exquisite marble appearance for decorative effect, in addition to the advantageous properties describe above.

One of the advantages of the process disclosed in the present invention is that the inorganic hardness-reinforcement powder can be obtained as spent marble powder from marble processing plants, and the aluminum alloys can be obtained from those alloys that are considered having secondary quality, or relatively low quality, aluminum alloys. Furthermore, as described above, the compositing process can be conducted at low temperatures. Therefore, as a result of the present invention, very useful, high quality and decorative foamed aluminum alloy composite plates can be made from essentially waste materials at relatively low cost.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

The present invention discloses foamed aluminum alloy composites prepared by compositing conventional foamed aluminum alloys with a hardness-reinforcement material so as to improve their strength while retaining all the advantages thereof, such as light weight, good heat insulation, sound shield effect, and good heat resistance. The foamed aluminum alloy composites disclosed in the present invention can be utilized in many applications, such as in building construction and in vehicle pans.

In preparing the foamed aluminum alloy composites disclosed in the present invention, a conventional foamed aluminum alloy plate is first prepared in the usual manner. Then a hardness-reinforcement composition is prepared by mixing the following components:

(1) About 54~64 wt. % of an inorganic hardness-reinforcement powder, which can be any waste mineral powder such as marble powder, granite powder, alabaster powder, or serpentine powder. These powders can be obtained as processing waste from, for example, marble processing plants. Preferably, the particle sizes of the inorganic hardness-reinforcement powders should be in the range between 50~100 μm.

(2) About 35~45 wt. % of a nonflammable curable resin, such as epoxy resin or PVC; and (3) About 1 wt. % of a curing agent such as low molecular weight amine or phenol.

The compositing of the foamed aluminum alloy plate with the hardness-reinforcement composition is conducted by soaking the foamed aluminum alloy plate with the hardness-reinforcement composition under pressure, so as to allow a layer of the hardness-reinforcement composition to be coated on the surface of the porous body of the foamed aluminum alloy plate. Thereafter, the hardness-reinforcement composition is cured by drying.

Figure 1:
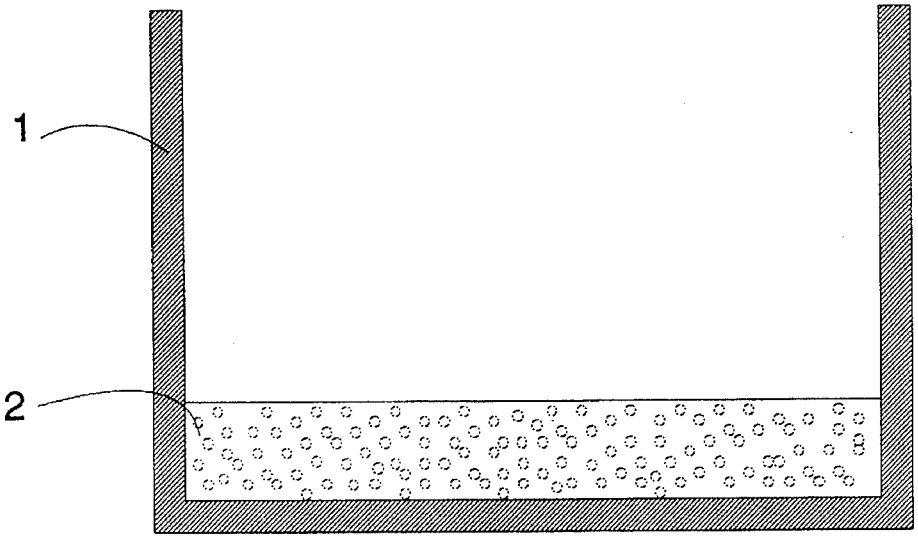
FIG. 1 is a schematic drawing illustrating the hardness-reinforcement coating composition contained in a container.
Figure 2:
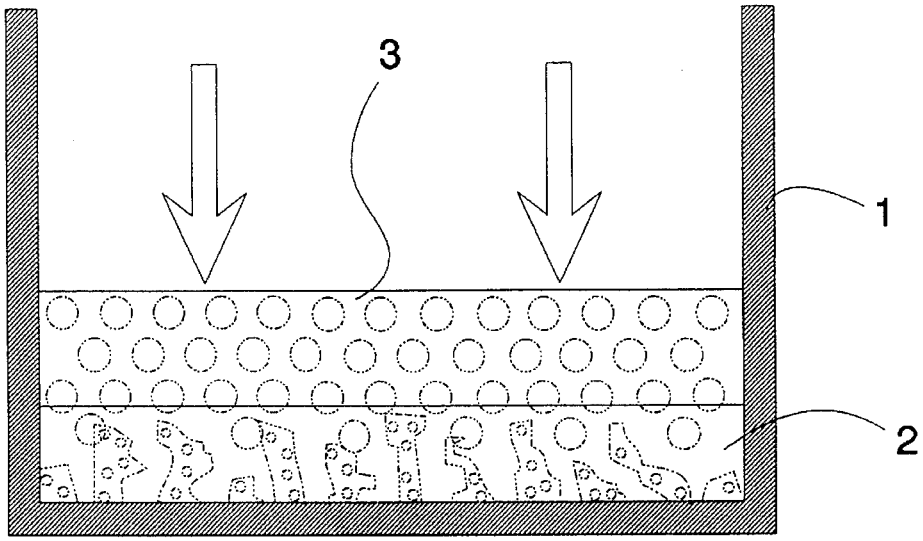
FIG. 2 is a schematic drawing illustrating a foamed aluminum alloy plate being immersed in the hardness-reinforcement coating composition by a force applied thereupon.

Now refer to the drawings. FIG. 1 is a schematic drawing illustrating the hardness-reinforcement coating composition 2 contained in a container 1. And FIG. 2 is a schematic drawing illustrating a foamed aluminum alloy plate 3 being immersed in the hardness-reinforcement coating composition 2 by a force, indicated by the arrows, applied thereupon. The hardness-reinforcement composition 2 so prepared is placed into a liquid container 1, into which the foamed aluminum alloy plate 3 is at least partially immersed. A pressure of about 10~50 Kg/cm$^2$, as indicated by the arrows, is applied upon the foamed aluminum alloy plate 3 to keep it at least partially immersed in the hardness-reinforcement composition 2, where it is soaked. Then the hardness-reinforcement composition 2 is allowed to penetrate into the porous space of the foamed aluminum alloy plate 3 for about one to two hours. Thereafter, the soaked foamed aluminum alloy plate 3 is removed from the hardness-reinforcement composition 2, and is then dried to allow the curable resin to be cured and hardened. Finally the exterior surface of the foamed aluminum alloy composite plate is polished, if necessary and/or desired. The thickness of the coating composition coated on the internal porous surface of the foamed aluminum alloy plate can be adjusted by adjusting the pore size of the porous body.

Since the inorganic hardness-reinforcement powder can be obtained as waste marble powder from marble processing plants, and the aluminum alloys can be of secondary quality aluminum alloys, the present invention allows very useful and high quality foamed aluminum alloy composites to be made from essentially industrial wastes. Furthermore, since the compositing process can be performed at low temperature, relatively low production cost is incurred.

The present invention will now be described more specifically with reference to the following examples. It is to be noted that the following descriptions of example including preferred embodiment of this invention are presented herein for purpose of illustration and description; it is not intended to be exhaustive or to limit the invention to the precise form disclosed.

EXAMPLE 1

An inorganic hardness-reinforcement composition was prepared which contained: (1) 64 wt. % of marble powder having diameters from 50~100 μm; (2) 35 wt. % of an epoxy resin; and (3) 1 wt. % of amine curing agent. The mixture was stirred at room temperature then placed inside a tank. A foamed aluminum alloy plate was placed on top of the inorganic hardness-reinforcement composition. Then a compression stress of 30 Kg/cm$^2$ was applied on the foamed aluminum alloy plate to force it at least partially immersed into the inorganic hardness-reinforcement composition. The force was continued for one hour. The thickness of the inorganic hardness-reinforcement composition layer coated on the surface of the inner porous body was measured to be about 1 mm. Then the foamed aluminum alloy plate was removed from the tank, and was dried to allow the curable resin to become cured. After polishing, the compression strength of the foamed aluminum alloy composite plate was measured to be 260 Kg/cm$^2$.

OTHER EXAMPLES

A number of other tests were conducted, and the results are summarized in Table 1. These tests were conducted under conditions similar to those described in Example 1.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

| | Conventional Foamed | Foamed Aluminum Alloy Composite Plate | |
|---|---|---|---|
| | Aluminum Plate* | 1 mm of coated thickness | 2 mm of coated thickness |
| Compressional Strength (Kg$_f$/cm$^2$) | 40~70 | 200~300 | 450~600 |
| Flexural Strength (Kg$_f$/cm$^2$) | 35~50 | 210~450 | 500~750 |

*specific density: 0.47~0.53

What is claimed is:

1. A foamed aluminum alloy composite comprising:

(a) a foamed aluminum alloy plate having an internal porous body with an internal porous surface; and (b) a hardness-reinforcement composition that has been coated on said internal porous surface of said internal porous body of said foamed aluminum alloy plate;

(c) wherein said hardness-reinforcement composition contains an inorganic powder dispersed in a nonflammable resin that has been cured by a curing agent.

2. A foamed aluminum alloy composite according to claim 1 wherein said inorganic powder is a mineral powder having a hardness similar to or greater than that of marble.

3. A foamed aluminum alloy composite according to claim 1 wherein said inorganic powder is a mineral powder selected from the group consisting of marble powder, granite powder, alabaster powder, and serpentine powder.

4. A foamed aluminum alloy composite according to claim 1 wherein said inorganic powder is marble powder.

5. A foamed aluminum alloy composite according to claim 1 wherein said inorganic powder is a waste marble powder from a marble processing plant.

6. A foamed aluminum alloy composite according to claim 1 wherein said nonflammable resin is selected from the group consisting of epoxy resin and polyvinyl chloride.

7. A foamed aluminum alloy composite according to claim 1 wherein said foamed aluminum alloy plate has a specific density between about 0.47 and 0.53.

8. A foamed aluminum alloy composite according to claim 1 wherein said curing agent is selected from the group consisting of phenol and amine.

9. A foamed aluminum alloy composite according to claim 1 which is made by a process comprising the following steps:

(a) placing a liquid solution containing said hardness-reinforcement composition into a tank, said hardness-reinforcement composition containing about 54~64 wt. % of an inorganic powder, about 35~45 wt. % of a nonflammable curable resin, and about 1 wt. % of a curing agent;

(b) at least partially submersing said foamed aluminum alloy plate into said tank containing said hardness-reinforcement composition, then applying a pressure of about 10~50 Kg/cm$^2$ onto said foamed aluminum alloy plate so as to allow said hardness-reinforcement composition to soak into said foamed aluminum alloy plate and form a coated layer on said internal porous surface of said internal porous body;

(c) removing said foamed aluminum alloy plate whose internal porous surface has been coated with a layer of said hardness-reinforcement composition from said tank; and (d) curing said nonflammable curable resin so as to form said foamed aluminum alloy composite.

10. A foamed aluminum alloy composite according to claim 1 which is provided in the form of a plate whose exterior surface has been polished.

* * * * *